United States Patent [19]

Lautenschläger

[11] 4,373,230

[45] Feb. 15, 1983

[54] FOUR-JOINT HINGE

[75] Inventor: Karl Lautenschläger, Reinheim, Fed. Rep. of Germany

[73] Assignee: Karl Lautenschläger KG, Möbelbeschlagfabrik, Reinheim, Fed. Rep. of Germany

[21] Appl. No.: 290,229

[22] Filed: Aug. 5, 1981

[30] Foreign Application Priority Data

Sep. 8, 1980 [DE] Fed. Rep. of Germany ..... 3033713

[51] Int. Cl.[3] ..... E05F 1/08; E05F 5/02

[52] U.S. Cl. ..... 16/288; 16/294

[58] Field of Search ..... 16/288, 287, 291, 282, 16/293, 294, 295

[56] References Cited

U.S. PATENT DOCUMENTS 3,940,828 3/1976 Lautenschlager ..... 16/288

4,050,116 9/1977 Salice ..... 16/288

4,123,823 11/1978 Lautenschlager ..... 16/288

4,166,307 9/1979 Rock ..... 16/288

4,184,228 1/1980 Lautenschlager ..... 16/294 X 4,247,965 2/1981 Lautenschlager ..... 16/294

*Primary Examiner*—Paul A. Bell

*Assistant Examiner*—John S. Brown

[57] ABSTRACT

Cabinet hinge (10,50) whose articulation is constituted by two hinge links (18, 20) pivotingly articulated to a door-related hinge part (14) at one end and to a supporting-wall-related part (16) at the other end in the manner of a four-joint articulation. One of the two hinge links (18) has ears (24) bent over from its lateral longitudinal edges toward the other hinge link (20), the ears being of such shape and dimensions that their free edges will abut flatly in the widest-open position of the hinge against the other hinge link (20) over at least a portion of their length.

8 Claims, 6 Drawing Figures

Figure 1:
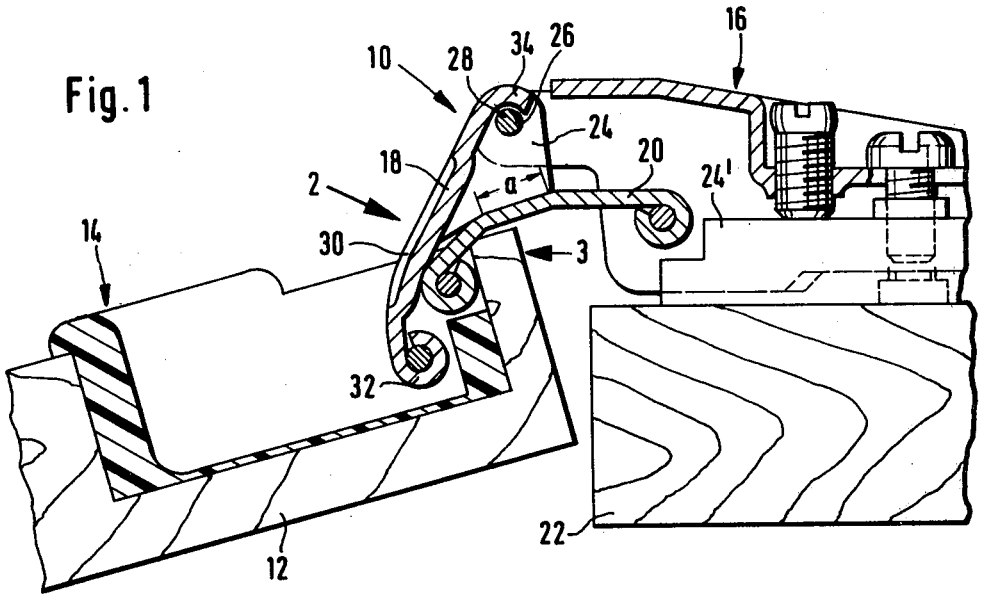

Fig. 4
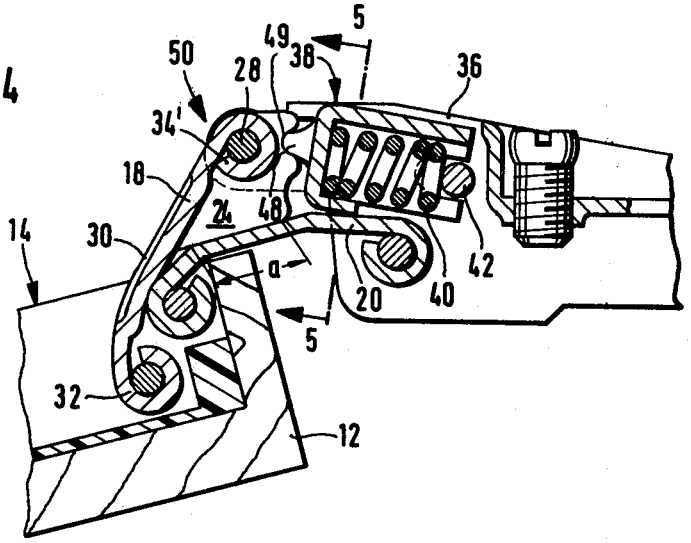
Fig. 5
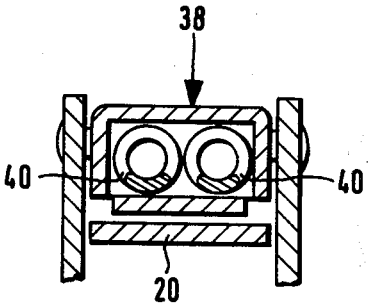
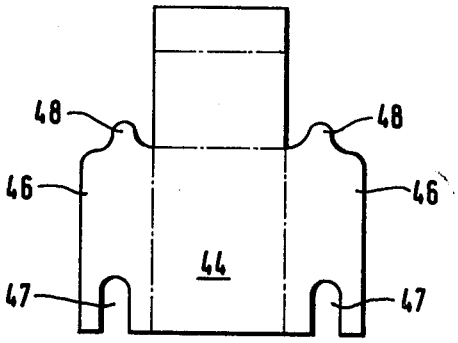
Fig. 6

FOUR-JOINT HINGE

BACKGROUND

The invention relates to a hinge for cabinet doors, having two hinge links pivotingly articulated at one end to a door-related part of the hinge and at the other end to a supporting-wall-related hinge part in the form of an elongated supporting arm, one of the hinge links having at its supporting-wall end a pair of ears bent at right angles toward the other hinge link.

Four-joint hinges today usually have hinge links stamped from sheet metal and provided at their extremities with rolled eyes for articulation to the door-related and supporting-wall related hinge parts, and these links have been found valuable even for the hanging of large and heavy doors from the carcass of cabinets, because they have a high resistance to deformation in the direction of the force produced by the weight of the door. On the other hand, these hinge links have less resistance to distortion by a force acting at right angles to the pivot axis. For example, the hinge links can be deformed if a door that has been opened all the way is forcibly pushed further in the opening direction. This is, of course, hardly possible in practice, because as a rule in this case the edge of the door comes in contact with the edge of the supporting wall and thus the stress on the hinge links is relieved. Nevertheless, in some cases, as for example in the case of cabinets having a set-back supporting wall edge, it is not entirely impossible that distortion of the hinge links can be caused by the excessive application of force upon the opening of the door.

In addition to the above-described hinges provided with flat hinge links, a hinge of the kind mentioned in the beginning is known (DE-OS No. 2,656,305) in which, at the supporting arm end of the outer hinge link, the otherwise common rolled pivot eye is replaced by laterally bent ears which have pivot holes through which the associated supporting-wall-related pivot pin is introduced. This type of articulation of the hinge link to the supporting arm is selected in the case of the known hinge because the back portion of the hinge link is prolonged to form a projection extending beyond the pivot axis, and this projection is engaged by the spring-biased presser of an over-center mechanism, and therefore the back of the link cannot be used for the rolling of the pivot eye. Furthermore, the ears of the hinge link do not result in any great reinforcement of the hinge link against distortion.

THE INVENTION

It is the object of the invention to improve the known four-joint hinges such that it will no longer be possible for the hinge links to become distorted by a force acting in the direction of the opening of the door which is hung thereby.

Setting out from a hinge of the kind mentioned in the beginning, this problem is solved in accordance with the invention by the fact that the lateral ears are so shaped and dimensioned that their free edges abut flatly against the lateral marginal areas of the confronting flat back of the other hinge link over at least a portion of their length when the door is in its widest-open position. In other words, the hinge links abut against one another by means of the ears when the hinge is in the open state, and the ears additionally increase the resistance to distortion of the hinge link on which they are formed. Since these ears flatly abut lengthwise against the second hinge link when in the critical open position, there is no danger of distortion of this second link, either, so that it can continue to be made in the usual form, i.e., in the form of a flat link with rolled pivot eyes.

In a preferred embodiment of the invention, the ears—the same as in the above-described, known over-center hinge, though for another reason—are provided on the outer hinge link at the end which is to be attached to the supporting arm, and they have pivot holes through which the pivot pin articulating the hinge link to the supporting arm is introduced.

In addition, the pivot pin can pass through a pivot eye formed by rolling over a prolongation of the back portion of the link and aligned with the pivot holes in the ears. In this embodiment, the bearing surface area on which the outer hinge link is articulated to the supporting arm is the same as that provided by a rolled pivot eye, which is greater than that provided by pivot holes in the ears alone, and better capable of withstanding stress.

The hinge constructed in accordance with the invention in the manner described above can also be made in the form of an over-center hinge whose operation is similar to the over-center hinge mentioned above, by providing in the outer or back portion of the end of the supporting arm on which the links are mounted an opening in which a presser thimble is disposed, which thimble is biased in the direction of the door-related hinge part by at least one helical spring abutting against the supporting arm and engages the ears of the outer hinge link such as to form a lever arm fulcrumed on the pivot axis at the supporting arm end of this link, this lever arm acting in the closing direction when the hinge is in the closed state and in the opening direction when the hinge is in the open state. However, in contrast to the known hinge, the presser thimble is this case does not engage a prolongation of the back portion of the hinge link, but instead engages the lateral ears. In this manner it is possible to roll a pivot eye on the hinge link.

The presser thimble is then preferably made from a metal stamping having two ears bent laterally away from a back portion situated in the opening in the supporting arm and aligned with the ears of the hinge link, and a notch is provided in each ear of one of the pairs of confronting ends of the ears of the hinge link and presser thimble and is engaged by a projection of the other pair of ears.

An additional improvement of the resistance of the outer hinge link to distortion can be achieved by pressing a shallow indentation running lengthwise along its back.

Figure 2:
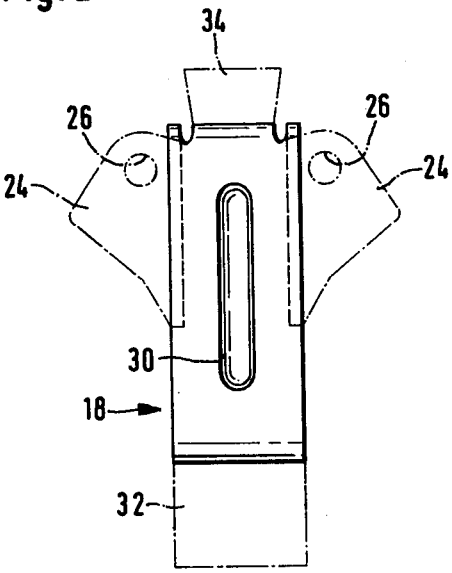
Figure 3:
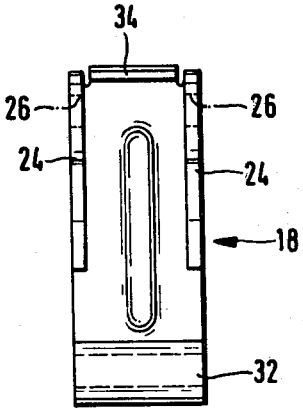

The invention will be further explained in the following description of two embodiments in conjunction with the drawing wherein:

FIG. 1 is a cross section taken through a plane extending through the longitudinal central axis of a first embodiment of a hinge in accordance with the invention, in the open state, FIG. 2 is a top view of the outer hinge link, as seen in the direction of arrow 2 in FIG. 1, FIG. 3 is a bottom view of the outer hinge link, as seen in the direction of arrow 3 in FIG. 1, FIG. 4 is a cross-sectional view taken along a plane extending through the longitudinal central axis of a second embodiment of the hinge of the invention, which in this case is an over-center hinge, also in the open state, FIG. 5 is a cross-sectional view as seen in the direction of the arrows 5—5 of FIG. 4, and FIG. 6 is a development of the presser thimble of the over-center mechanism of the over-center hinge shown in FIG. 4.

The hinge of the invention, designated as a whole by the number 10 in FIG. 1, is a so-called four-joint hinge, in which the door-related hinge part, in the form of a cup 14 sunk or driven into a corresponding recess of the cabinet door 12 is articulated to the supporting-wall-related hinge part, in the form of an elongated supporting arm 16, by means of two hinge links 18 and 20. The supporting arm 16 is fastened in a known manner on a mounting plate 24' affixed to the side wall 22. Up to this point, hinge 10 is the same as conventional four-joint hinges.

The outer hinge link 18, which is the one more remote from the supporting wall 22, has at its supporting-arm end two ears 24 bent laterally away from it, which in the illustrated case have pivot holes 26 to accommodate the corresponding pivot pin 28 which is riveted in the supporting arm 16 and forms the pivot axis for the hinge link 18, but the ears are also of such shape and dimensions that, when the hinge is in the open position, they engage or abut against the lateral marginal area of the back of the inner hinge link 20 over the length a, in the manner which is presented in the drawing. It is readily apparent that the ears 24 considerably strengthen the resistance of the hinge link 18 to deformation in the direction in which the door is opened, inasmuch as the opening pressure is transferred by the ears to the inner hinge link 20. As another measure for increasing the resistance of hinge link 18 to distortion, a longitudinally disposed indentation 30 is additionally formed in it by pressing.

In FIGS. 2 and 3 the outer hinge link 18 is again shown separately in a top and bottom view, broken lines also indicating in FIG. 2 the outline of the planar stamped blank for the link, before the ears 24 are bent, the pivot eye 32 at the door end is rolled, and the projection 34 at the supporting wall end is bent between the ears 24.

The embodiment of a hinge 50 in accordance with the invention which is shown in FIG. 4 to a great extent resembles the above-described hinge 10, so that it will suffice hereinafter to point out the differences, while for the general construction of the hinge the above description can be consulted, inasmuch as the same reference numbers are used for equal parts in the two hinges.

The first important difference from hinge 10 is that the hinge 50 is an over-center hinge, the over-center mechanism being formed by a presser thimble 38 disposed in an opening 36 in the back of the supporting arm 16, the presser thimble being biased against the supporting-arm end of the hinge link 18 by two parallel helical springs 40 which are under compressive bias. The ends of the coil springs 40 facing the interior of the supporting arm abut against a cross pin 42 riveted in the supporting arm 16. The presser thimble 38 itself is a piece stamped and bent from sheet metal, and its development is shown in FIG. 6. From the latter figure it can be seen that the presser thimble consists of an elongated rectangular body section 44 adjoined by two ears 46 which, after the piece has been stamped out, are bent at right angles along the bending line indicated by the dash-dotted lines. The width of the body section 44 is such that the ears 46 will be in line with the ears 24 of the hinge link 18 after the pressure piece 38 has been inserted into the supporting arm 16. The additional transverse bending lines indicated by the transverse broken lines in the body section 44 in FIG. 6 show the areas in which the body section 44 is bent to form the largely closed form, open at only the bottom and rear end, which is seen in FIG. 4. The ears 46 have at each of their front edges facing the hinge links 18 a projection 48 which is slightly rounded at the free end, each projection 48 being engaged in a notch 49 in the edge of each ear 24, where they transmit to the hinge link 18 the compressive bias of the helical springs 40, in the manner of a point support. Since the projections 48 are applied to the link 18 through a lever arm fulcrumed at the longitudinal central axis of the pivot pin 28, a moment is exercised on the hinge link 18 which seeks to rotate it counterclockwise. This moment then produces the desired over-center action of the hinge. The slots 47 made in the ears guide the presser thimble 38 on the cross-pin 42, the slots 47 being of such length that the presser thimble can perform the required longitudinal movement.

Another difference from hinge 10 is to be seen in the fact that the prolongation 34 provided in hinge 10 is longer and is rolled to form a pivot eye 34' which provides the hinge link 18 with additional bearing surface on the pivot pin 28. It is clear that in this manner a reduction of the specific bearing stress is achieved, and with it a lengthening of the life of this pivot point.

We claim:

1. A hinge for a cabinet door, comprising: two hinge links pivotingly articulated in the manner of a four-joint hinge, each at one end to a door-related hinge part adapted to be fastened to the cabinet door and each at the other end to a supporting-wall related hinge part adapted to be fastened to a supporting wall of a cabinet, one of said hinge links having at an end portion adjacent the supporting-wall related part two ears bent over at right angles in the direction toward the other hinge link, said ears being of such shape and size that their free edges flatly rest over at least a portion of their length on areas of a confronting flat side of the other hinge link when the cabinet door is in its widest-open position.

2. A hinge according to claim 1, wherein said one hinge link is the one that is more remote from the supporting-wall related hinge part than the other and wherein the ears have pivot holes through which is mounted a pivot pin for articulating the one hinge link pivotably to the supporting-wall related hinge part.

3. A hinge according to claim 2, wherein the pivot pin additionally passes through a prolongation of a web portion of the one hinge link, which prolongation is rolled to a pivot eye aligned with the pivot holes in the ears.

4. A hinge link according to claim 2, wherein an opening is provided in an end portion of the supporting-wall related part which holds the hinge links, a pressor piece biased by at least one helical spring abutting against the supporting-wall related part in the direction of the door-related hinge part, which presser piece engages the ears of the one hinge link and forms with the pivot axis of said one link at the supporting-wall related hinge part a lever arm which is acted upon by the bias of the pressure piece in the sense of a swinging in the closing direction of the door in the hinge-closed position and in the sense of a swinging in the opening direction of the door in the hinge-open position.

5. A hinge link according to claim 3, wherein an opening is provided in an end portion of the supporting-wall related part which holds the hinge links, a presser piece biased by at least one helical spring abutting against the supporting-wall related part in the direction of the door-related hinge part, which presser piece engages the ears of the one hinge link and forms with the pivot axis of said one link at the supporting-wall related hinge part a lever arm which is acted upon by the bias of the pressure piece in the sense of a swinging in the closing direction of the door in the hinge-closed position and in the sense of a swinging in the opening direction of the door in the hinge-open position.

6. A hinge according to claim 4, wherein the presser piece is a piece stamped from sheet metal, which has two ears bent laterally away from a web section lying in the opening in the supporting-wall related part, said ears being in alignment with the ears of the one hinge link, notches being provided in the ends of one of said pairs of ears and projections in each ear of the other pair of ears where the pairs confront each other.

7. A hinge according to claim 5, wherein the presser piece is a piece stamped from sheet metal, which has two ears bent laterally away from a web section lying in the opening in the supporting-wall related part, said ears being in alignment with the ears of the one hinge link, notches being provided in the ends of one of said pairs of ears and projections in each ear of the other pair of ears where the paris confront each other.

8. A hinge according to any one of claims 1 to 7, wherein a shallow indentation is pressed into and extends in the longitudinal direction of said one hinge link.

* * * * *